US009246293B2

(12) United States Patent
Vino, IV et al.

(10) Patent No.: US 9,246,293 B2
(45) Date of Patent: Jan. 26, 2016

(54) LEADFRAME FOR A CONTACT MODULE AND METHOD OF MANUFACTURING THE SAME

(71) Applicant: Tyco Electronics Corporation, Berwyn, PA (US)

(72) Inventors: Michael Joseph Vino, IV, Landisville, PA (US); Leo Joseph Graham, Hershey, PA (US); Michael Christopher D'Imperio, Lancaster, PA (US); David Allison Trout, Lancaster, PA (US); Wayne Samuel Davis, Harrisburg, PA (US); Rodney Timothy Yancey, East Petersburg, PA (US); Jeffrey Byron McClinton, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 159 days.

(21) Appl. No.: 14/069,012

(22) Filed: Oct. 31, 2013

(65) Prior Publication Data

US 2015/0118921 A1 Apr. 30, 2015

(51) Int. Cl.

| | |
|---|---|
| ***H01R 9/24*** | (2006.01) |
| ***H01R 43/16*** | (2006.01) |
| ***H01R 12/72*** | (2011.01) |
| ***H01R 13/6587*** | (2011.01) |

(52) U.S. Cl.

CPC ..... *H01R 43/16* (2013.01); *H01R 12/724* (2013.01); *H01R 13/6587* (2013.01)

(58) Field of Classification Search

CPC ..... H01R 43/16; H01R 13/112; H01R 13/11; H01R 13/658; H01R 13/6587; H01R 12/737; H01R 24/30; Y10S 439/941

See application file for complete search history.

(56) References Cited

U.S. PATENT DOCUMENTS

| | | | | |
|---|---|---|---|---|
| 4,607,907 | A | 8/1986 | Bogursky | |
| 5,077,893 | A * | 1/1992 | Mosquera et al. | 29/882 |
| 5,782,644 | A * | 7/1998 | Kiat | 439/79 |
| 5,980,321 | A | 11/1999 | Cohen et al. | |
| 6,116,926 | A | 9/2000 | Ortega et al. | |
| 6,224,432 | B1 | 5/2001 | Billman | |
| 6,769,935 | B2 * | 8/2004 | Stokoe et al. | 439/607.1 |
| 7,883,366 | B2 * | 2/2011 | Davis et al. | 439/607.01 |
| 8,408,939 | B2 | 4/2013 | Davis et al. | |
| 8,944,831 | B2 * | 2/2015 | Stoner et al. | 439/108 |
| 2013/0210246 | A1 * | 8/2013 | Davis et al. | 439/65 |

* cited by examiner

*Primary Examiner* — Jean F Duverne

(57) ABSTRACT

A leadframe for a contact module includes signal contacts arranged in pairs carrying differential signals. Each pair of signal contacts includes a first signal contact and a second signal contact. Each signal contact has a mating beam at an end thereof configured to be electrically connected to a corresponding header contact of a header assembly. Each mating beam includes a stem and a branch extending from the stem. A first paddle extends from the stem and a second paddle extends from the branch. In an initial, stamped orientation, the mating beams are stamped such that the mating beams of the first and second signal contacts within the same pair of signal contacts are angled non-parallel to one another.

19 Claims, 5 Drawing Sheets

LEADFRAME FOR A CONTACT MODULE AND METHOD OF MANUFACTURING THE SAME

BACKGROUND OF THE INVENTION

The subject matter herein relates generally to a leadframe for a contact module and a method of manufacturing the same.

Some electrical connectors include individual contact modules or chicklets that are loaded into a connector housing. The contact modules typically have signal contacts arranged in pairs that carry differential signals. Some conventional contact modules are formed from an overmolded leadframe(s). For an improved electrical connection, the signal contacts of at least some known contact modules have mating ends with opposed beams or paddles that mate to both sides of a corresponding header signal contact for redundant or multiple points of contact. However, due to the excessive amount of material needed to form the double beam at the mating end, the signal contacts require a large pitch or spacing distance therebetween, which leads to a large overall profile or a reduction in the density of signal contacts within the electrical connector. To overcome such problems, at least some known contact modules include two overmolded leadframes that overlay or internest with each other to form the contact module. Such design is costly and difficult to manufacture. Additionally, because such design includes two overmolded leadframes, the time to manufacture such contact modules is doubled as compared to designs that use a single overmolded leadframe.

A need remains for an improved contact module and electrical connector design that has high density and low manufacturing costs.

BRIEF DESCRIPTION OF THE INVENTION

In one embodiment, a leadframe for a contact module is provided that includes signal contacts arranged in pairs carrying differential signals. Each pair of signal contacts includes a first signal contact and a second signal contact. Each signal contact has a mating beam at an end thereof configured to be electrically connected to a corresponding header contact of a header assembly. Each mating beam includes a stem and a branch extending from the stem. A first paddle extends from the stem and a second paddle extends from the branch. In an initial, stamped orientation, the mating beams are stamped such that the mating beams of the first and second signal contacts within the same pair of signal contacts are angled non-parallel to one another.

Optionally, a centerline may be defined between the mating beams of the first and second signal contacts within the same pair. The first paddle of the mating beam associated with the first signal contact may extend along a first paddle axis angled oblique with respect to the centerline. The first paddle of the mating beam associated with the second signal contact may extend along a second paddle axis angled oblique with respect to the centerline. The first and second paddle axes may be angled inward at approximately equal angles relative to the centerline.

Optionally, a centerline may be defined between the mating beams of the first and second signal contacts within the same pair. The first paddle of the mating beam associated with the first signal contact may extend along a first paddle axis angled oblique with respect to the centerline. The second paddle of the mating beam associated with the first signal contact may extend along a second paddle axis generally parallel to the first paddle axis.

Optionally, the mating beams may be arranged on a tight pitch. Optionally, if the mating beams were not angled inward, the mating beams of adjacent pairs of signal contacts may overlap.

Optionally, a centerline may be defined between the mating beams of the first and second signal contacts within the same pair. The first paddles may be arranged interior of the second paddles closer to the centerline. The second paddles may have exterior edges facing outward away from the centerline. The exterior edges of the second paddles may be angled oblique with respect to the centerline. The second paddles may be outside of the first paddles. Adjacent second paddles of mating beams of signal contacts of different pairs may be angled away from each other.

Optionally, the branch and second paddle of each mating beam may be folded over the stem and first paddle of the corresponding mating beam such that the first and second paddles are parallel to one another and define a socket configured to receive the corresponding header contact. The mating beams may be moved outward to a final, formed orientation wherein each of the first and second paddles are parallel to one another.

In a further embodiment, a method of manufacturing a leadframe is provided that includes providing a leadframe by stamping a metal blank to include pairs of signal contacts having mating beams that are non-parallel to each other and forming the mating beams into a final form, the mating beams having a parallel alignment in the final form.

In another embodiment, a receptacle assembly is provided having a receptacle housing configured to be mated with a header assembly and contact modules received in the receptacle housing. Each contact module includes a dielectric frame having a front and opposite first and second sides and a leadframe held by the dielectric frame. The leadframe has signal contacts arranged in pairs carrying differential signals. The signal contacts are generally arranged along a leadframe plane parallel to and between the first and second sides. The signal contacts have mating beams at ends thereof each extending forward of the dielectric frame to be electrically connected to a corresponding header contact of the header assembly in a mating direction. Each mating beam includes a stem, a branch, a first paddle extending from the stem and a second paddle extending from the branch. The mating beams are stamped in an initial, stamped orientation such that the mating beams within the same pair of signal contacts are angled toward one another and such that the mating beams are angled away from the mating beams of any immediately adjacent pair of signal contacts. The branch and second paddle of each mating beam are folded over the stem and first paddle such that the first and second paddles are parallel to one another and define a socket for the corresponding header contact of the header assembly. The mating beams are pressed to a final, formed orientation such that each of the first and second paddles are parallel to the mating direction.

DETAILED DESCRIPTION OF THE INVENTION

Figure 1:
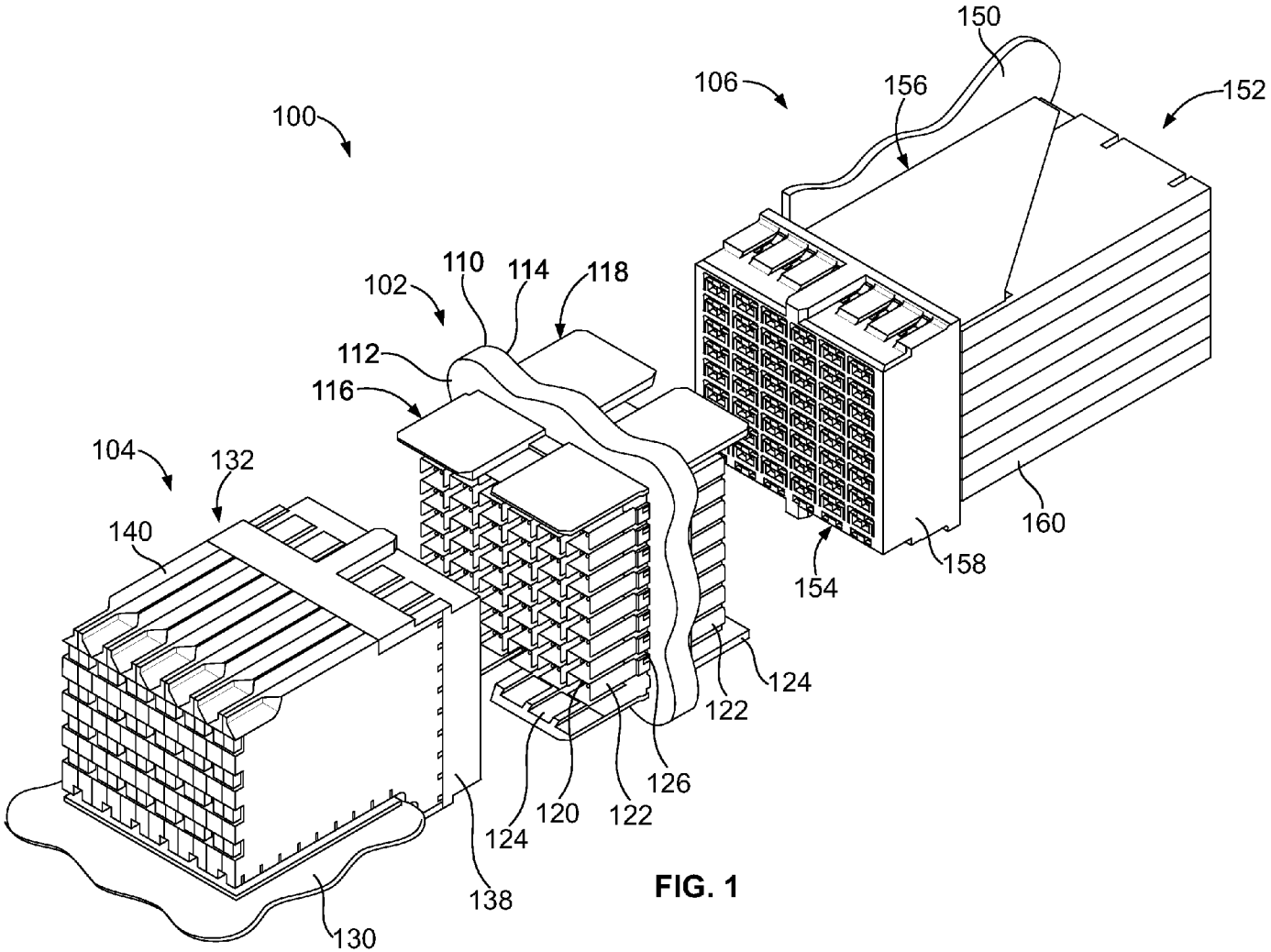
FIG. 1 is a perspective view of a connector system formed in accordance with an exemplary embodiment.

FIG. 1 is a perspective view of a connector system 100 formed in accordance with an exemplary embodiment. The connector system 100 includes a midplane assembly 102, a first connector assembly 104 configured to be coupled to one side of the midplane assembly 102 and a second connector assembly 106 configured to be connected to a second side the midplane assembly 102. The midplane assembly 102 is used to electrically connect the first and second connector assemblies 104, 106. Optionally, the first connector assembly 104 may be part of a daughter card and the second connector assembly 106 may be part of a backplane, or vice versa. The first and second connector assemblies 104, 106 may be line cards or switch cards. In alternative embodiments, the first and second connector assemblies 104, 106 may be directly coupled together without the use of the midplane assembly 102.

The midplane assembly 102 includes a midplane circuit board 110 having a first side 112 and second side 114. The midplane assembly 102 includes a first header assembly 116 mounted to and extending from the first side 112 of the midplane circuit board 110. The midplane assembly 102 includes a second header assembly 118 mounted to and extending from the second side 114 of the midplane circuit board 110. The first and second header assemblies 116, 118 each include header contacts 120 electrically connected to one another through the midplane circuit board 110. In an exemplary embodiment, the header contacts 120 are arranged in pairs configured to convey differential signals. The first and second header assemblies 116, 118 include header ground shields 122 that provide electrical shielding around corresponding header contacts 120. The first and second header assemblies 116, 118 each include a header housing 124 used to hold the header contacts 120 and the header ground shields 122.

The first connector assembly 104 includes a first circuit board 130 and a first receptacle assembly 132 coupled to the first circuit board 130. The first receptacle assembly 132 is configured to be coupled to the first header assembly 116. When the first receptacle assembly 132 is coupled to the first header assembly 116, the first circuit board 130 is orientated perpendicular with respect to the midplane circuit board 110.

The first receptacle assembly 132 includes a front housing 138 used to hold a plurality of contact modules 140. The contact modules 140 are held in a stacked configuration generally parallel to one another. The contact modules 140 hold a plurality of signal contacts (not shown) that are electrically connected to the first circuit board 130 and define signal paths through the first receptacle assembly 132. The signal contacts are configured to be electrically connected to the header contacts 120 of the first header assembly 116. In an exemplary embodiment, the contact modules 140 provide electrical shielding for the signal contacts. Optionally, the signal contacts may be arranged in pairs carrying differential signals.

The second connector assembly 106 includes a second circuit board 150 and a second receptacle assembly 152 coupled to the second circuit board 150. The second receptacle assembly 152 is configured to be coupled to the second header assembly 118. The second receptacle assembly 152 has a header interface 154 configured to be mated with the second header assembly 118. The second receptacle assembly 152 has a board interface 156 configured to be mated with the second circuit board 150. In an exemplary embodiment, the board interface 156 is orientated perpendicular to the header interface 154. When the second receptacle assembly 152 is coupled to the second header assembly 118, the second circuit board 150 is orientated perpendicular to the midplane circuit board 110. The second circuit board 150 is oriented perpendicular to the first circuit board 130.

The second receptacle assembly 152 includes a front housing 158 used to hold a plurality of contact modules 160. The contact modules 160 are held in a stacked configuration generally parallel to one another. The contact modules 160 hold a plurality of signal contacts 162 (shown in FIG. 2) that are electrically connected to the second circuit board 150 and define signal paths through the second receptacle assembly 152. The signal contacts 162 are configured to be electrically connected to the header contacts 120 of the second header assembly 118. In an exemplary embodiment, the contact modules 160 provide electrical shielding for the signal contacts 162. Optionally, the signal contacts 162 may be arranged in pairs carrying differential signals. In an exemplary embodiment, the contact modules 160 generally provide 360° shielding for each pair of signal contacts 162 along substantially the entire length of the signal contacts 162 between the board interface 156 and the header interface 154. The shield structure of the contact modules 160 that provides the electrical shielding for the pairs of signal contacts 162 is electrically connected to the header ground shields 122 of the second header assembly 118 and is electrically connected to a ground plane of the second circuit board 150.

In the illustrated embodiment, the first circuit board 130 is oriented generally horizontally. The contact modules 140 of the first receptacle assembly 132 are orientated generally vertically. The second circuit board 150 is oriented generally vertically. The contact modules 160 of the second receptacle assembly 152 are oriented generally horizontally. The first connector assembly 104 and the second connector assembly 106 have an orthogonal orientation with respect to one another.

Figure 2:
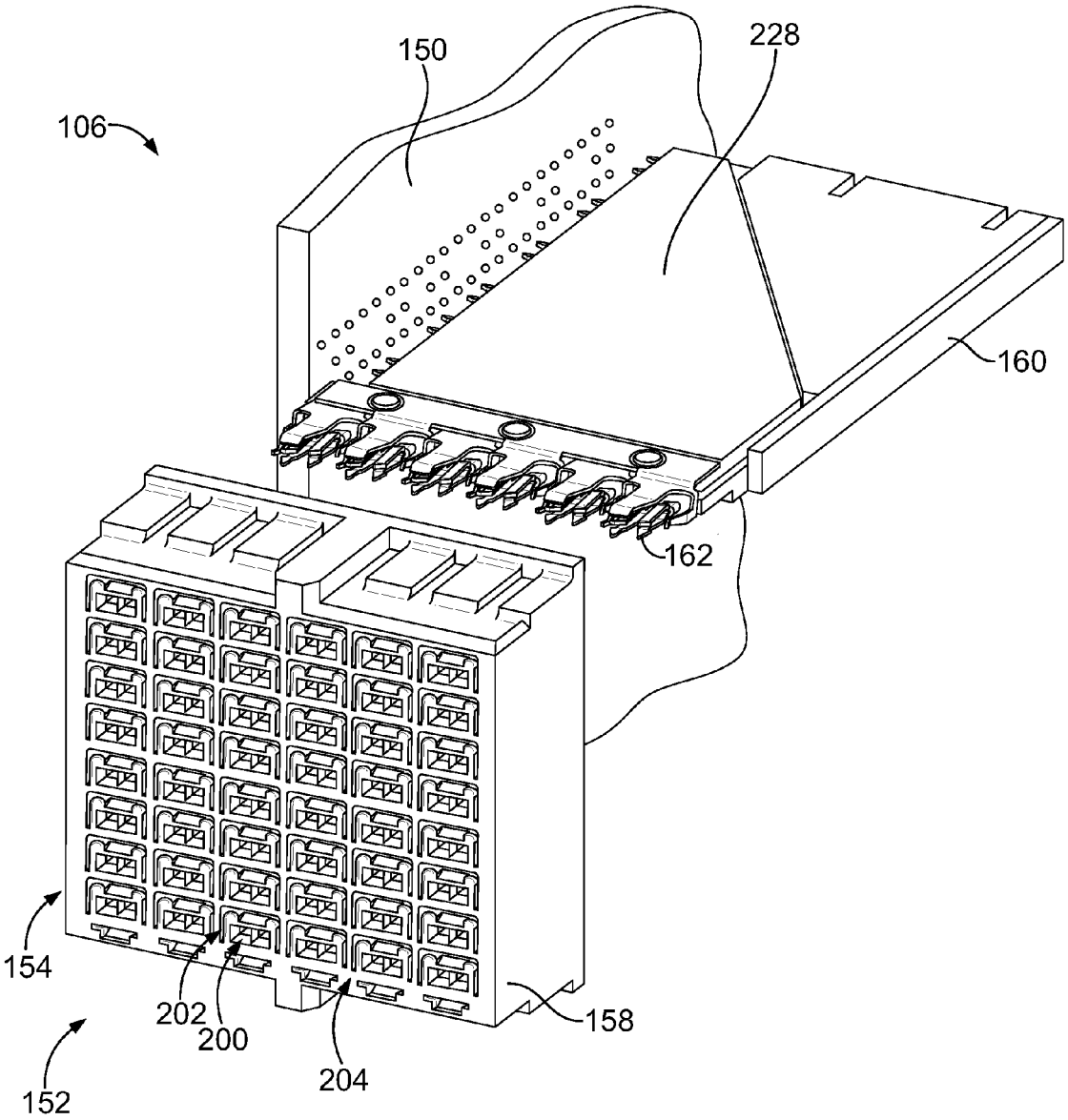
FIG. 2 is a front perspective view of a portion of a receptacle assembly showing a contact module thereof.

FIG. 2 is a front perspective view of a portion of the connector assembly 106 showing one of the contact modules 160 of the second receptacle assembly 152 poised for loading into the front housing 158 and mounting to the circuit board 150. The front housing 158 includes a plurality of signal contact openings 200 and a plurality of ground contacts openings 202 at a mating end 204 of the front housing 158. The mating end 204 defines the header interface 154 of the first receptacle assembly 152.

The contact module 160 is coupled to the front housing 158 such that the signal contacts 162 are received in corresponding signal contact openings 200. Optionally, a single signal contact 162 is received in each signal contact opening 200. The signal contact openings 200 may also receive corresponding header contacts 120 (shown in FIG. 1) therein when the receptacle and header assemblies 152, 118 are mated. The ground contact openings 202 receive corresponding header ground shields 122 (shown in FIG. 1) therein when the receptacle and header assemblies 152, 118 are mated. The ground contact openings 202 receive grounding members, such as grounding beams of a shield of the contact modules 160 that mate with the header ground shields 122 to electrically common the receptacle and header assemblies 152, 118.

The front housing 158 is manufactured from a dielectric material, such as a plastic material, and provides isolation between the signal contact openings 200 and the ground contact openings 202. The front housing 158 isolates the signal contacts 162 and the header contacts 120 from the header ground shields 122. The front housing 158 isolates each set of receptacle and header contacts 162, 120 from other sets of receptacle and header contacts 162, 120.

The ground contact openings 202 are C-shaped in the illustrated embodiment to receive the C-shaped header ground shields 122. Other shapes are possible in alternative embodiments, such as when other shaped header ground shields 122 are used. The ground contact openings 202 are chamfered at the mating end 204 to guide the header ground shields 122 into the ground contact openings 202 during mating. The signal contact openings 200 are chamfered at the mating end 204 to guide the header contacts 120 into the signal contact openings 200 during mating.

Figure 3:
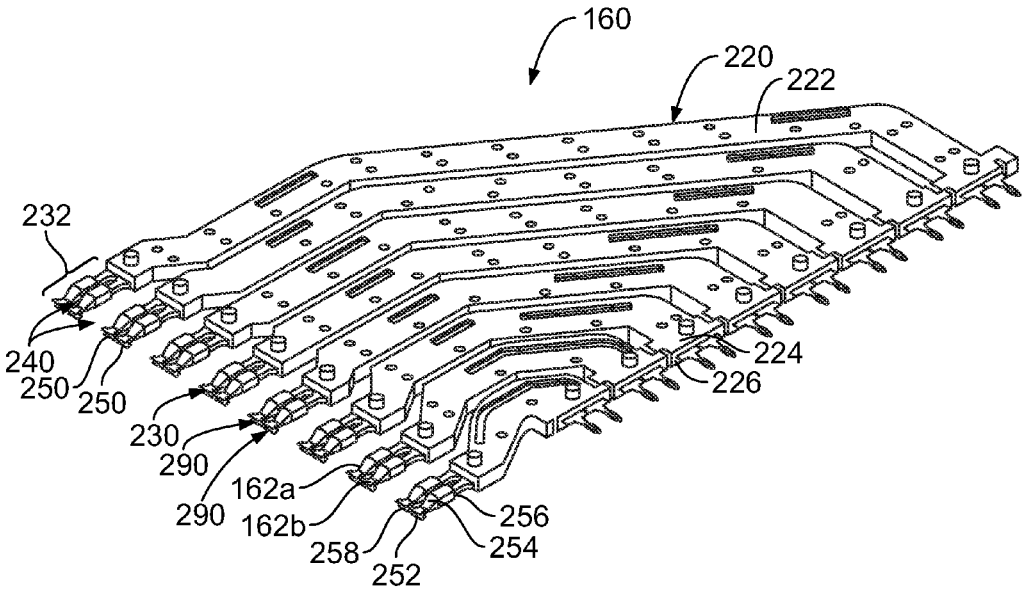
FIG. 3 illustrates the contact module for the receptacle assembly.

FIG. 3 illustrates one of the contact modules 160. The contact module 160 includes a frame assembly 220, which includes the signal contacts 162. The signal contacts 162 are arranged in pairs carrying differential signals and defining first signal contacts 162*a* and second signal contacts 162*b*. In an exemplary embodiment, the frame assembly 220 includes a dielectric frame 222 that surrounds the signal contacts. The dielectric frame 222 includes opposite sides 224, 226 that extend substantially parallel to and along the signal contacts 162. Optionally, the dielectric frame 222 may be overmolded over the signal contacts 162. Alternatively, the signal contacts 162 may be inset in a pre-molded frame assembly 220 or otherwise inserted into and/or held by the frame assembly 220.

The signal contacts 162 may form part of a leadframe 230 (shown in FIG. 4) that is overmolded to encase the conductors defining the signal contacts 162. A leadframe plane defined by the leadframe 230 is oriented parallel to and between the sides 224, 226 of the dielectric frame 222. In an exemplary embodiment, the contact module 160 includes a single leadframe 230, as opposed to multiple leadframes and corresponding frame assemblies 220 that are internested together as with some known conventional contact modules. Having a single leadframe 230 and single frame assembly 220 reduces the overall cost of the contact module 160, as compared to such multiple-piece contact modules. In an exemplary embodiment, the contact module 160 has a very high density of signal contacts 162 as compared to conventional contact modules of similar size. Embodiments of the signal contacts 162 described herein are stamped and formed in a way to allow for a high number of signal contacts 162 per length of the contact module 160. For example, the spacing between the signal contacts 162 within each pair is arranged on a tight pitch and the spacing between signal contacts 162 of different, adjacent pairs is arranged on a tight pitch.

The contact module 160 may include a ground shield 228 (shown in FIG. 2) that provides shielding for the signal contacts 162. The ground shield 228 may be attached to one or both sides 224, 226 of the dielectric frame 222. In an exemplary embodiment, the ground shield 2282 may include tabs that extend between pairs of the signal contacts 162 to provide shielding between each of the pairs of signal contacts 162.

Figure 4:
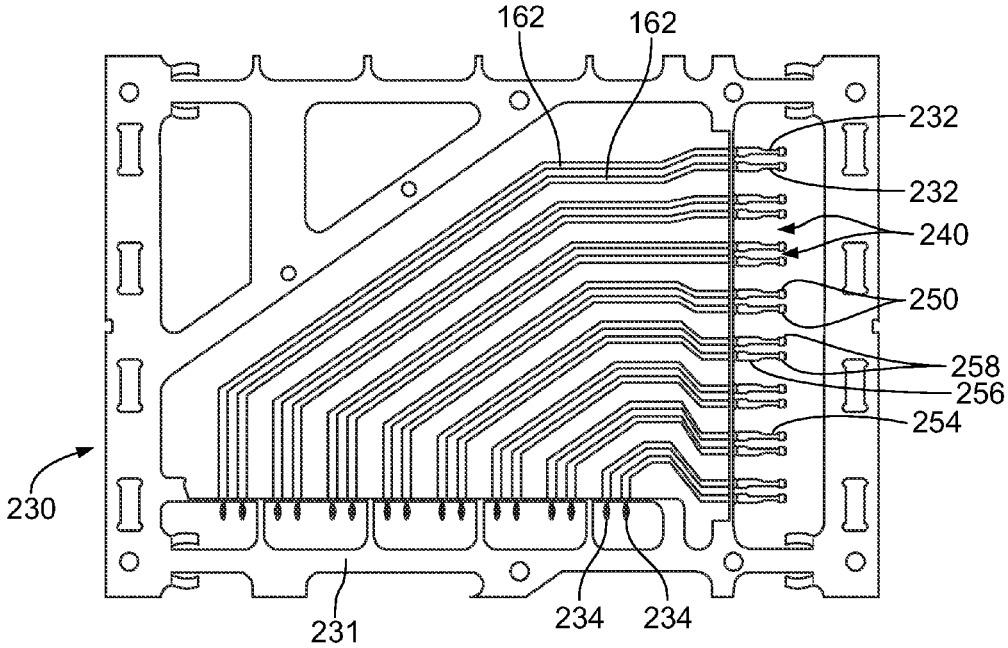
FIG. 4 illustrates a leadframe of the contact module.

With additional reference to FIG. 4, FIG. 4 illustrates a leadframe 230 of the frame assembly 220 that forms the signal contacts 162. The leadframe 230 is stamped and formed. The leadframe 230 is initially held together by a carrier 231 with connecting portions between each of the conductors. The carrier 231 and connecting portions are later removed, such as by a cutting or stamping process after the signal contacts 162 are held by the dielectric frame 222 (shown in FIG. 3).

The signal contacts 162 have mating beams 232 at a front of the leadframe 230 and mounting portions 234 at another end of the leadframe 230, such as a bottom of the leadframe 230. The front and bottom are generally perpendicular to one another. The mating beams 232 and mounting portions 234 may be provided at other portions of the leadframe 230 in alternative embodiments.

The leadframe 230 is generally planar and defines a leadframe plane. The mating beams 232 and mounting portions 234 are integrally formed with the conductors of the leadframe 230. The conductors extend along predetermined paths between each mating beam 232 and corresponding mounting portion 234. The mating beams 232 are configured to be mated with and electrically connected to corresponding header contacts 120 (shown in FIG. 1). The mounting portions 234 are configured to be electrically connected to the second circuit board 150 (shown in FIG. 2). For example, the mounting portions 234 may include compliant pins that extend into conductive vias in the second circuit board 150.

The mating beams 232 include a plurality of mating interfaces 250 to define multiple points of contact with the header contacts 120 (shown in FIG. 1). FIG. 4 illustrates the mating beams 232 in a final, formed orientation in which the mating beams 232 have been processed and manipulated into the final positions for mating with the header contacts 120. For example, the mating beams 232 may be pressed, bent, coined, stretched or otherwise moved outward to the final position. However, when initially stamped, the mating beams 232 have a different, pre-formed shape (such as the shape illustrated in FIG. 5). In the illustrated embodiment, in the final, formed orientation, the mating beams 232 define a wishbone type of contact having two, generally parallel paddles 252, 254. The dual paddle design allows each mating beam 232 to have two mating interfaces 250 with the corresponding header contact 120, providing a more robust electrical connection and better signal integrity. The paddles 252, 254 are deflectable during mating with the header contacts 120. The mating beams 232 have folded over portions 256 with the paddles 252, 254 on opposite sides of the folded over portions 256. The folded over portions 256 may be U-shaped channels with the paddles 252, 254 extending forward from the folded over portions 256. Other configurations are possible in alternative embodiments. Optionally, the mating beams 232 may have enlarged ends 258 at distal ends of the paddles 252, 254. The enlarged ends 258 may be used to locate the mating beams 232 within the signal contact openings 200 (shown in FIG. 2).

Gaps 240 are defined between the signal contacts 162. The gaps 240 between signal contacts 162 of different pairs may be relatively larger than the gaps 240 between the signal contacts 162 within a pair. The size or length of the gaps 240 may define the pitch(s) of the signal contacts 162. The pitch between the signal contacts 162 within the pair may be smaller than the pitch between adjacent signal contacts 162 of different pairs.

Each of the conductors defining signal contacts 162 has a predetermined length defined between the mating beams 232 and mounting portions 234. The lengths of the conductors may be different, due at least in part to the right angle nature of the contact module 160. For example, the radially inner conductors are generally shorter than the radially outer conductors. While the signal conductors within a differential pair have approximately equal lengths, because of factors such as the size constraint of the contact module 160 and the cost or complexity of manufacture, the radially inner signal contact 162 within each differential pair is generally slightly shorter than the radially outer signal contact 162 of the same differential pair. Any difference in length may lead to skew problems, as the signals within the differential pair travel along different path lengths. Skew compensation may be provided, such as by changing a width or thickness of the signal contacts 162 along predetermined lengths thereof and/or surrounding the signal contacts 162 with different dielectrics (such as plastic versus air) along predetermined lengths thereof.

Figure 5:
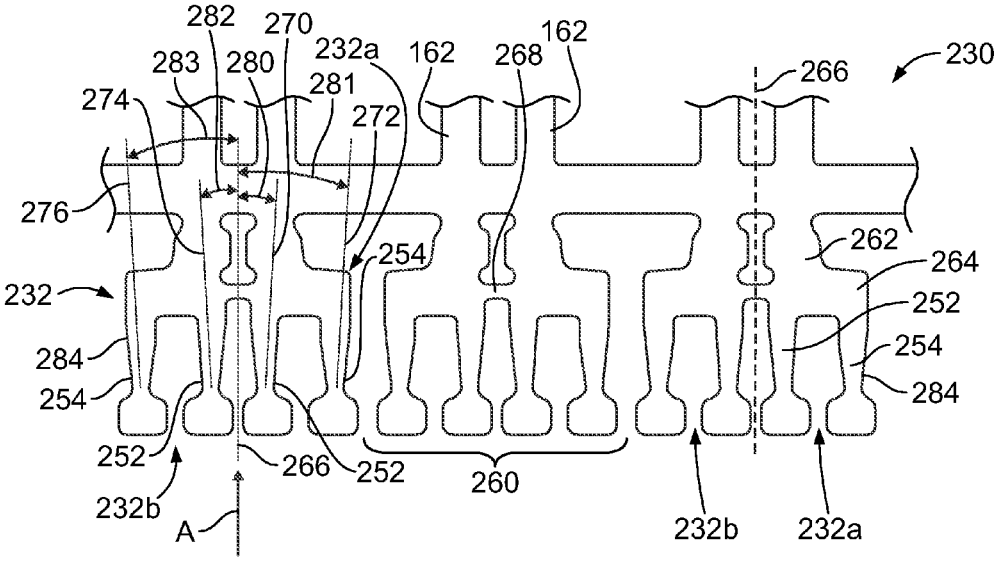
FIG. 5 illustrates a portion of the leadframe in an initial, stamped state, prior to bending or forming mating beams thereof.

FIG. 5 illustrates a portion of the leadframe 230 in an initial, stamped state, prior to bending or forming the mating beams 232. The initial state refers to a state at a time period prior to the final state, and it is realized that the leadframe 230 may have other states between the initial and final states and/or may have states prior to the initial state, such as an un-blanked or un-stamped state. The mating beams 232 are arranged at the ends of corresponding signal contacts 162. The signal contacts 162 and mating beams 232 are arranged in pairs 260. In FIG. 5, the mating beams 232 of each pair 260 are identified as a first mating beam 232*a* and a second mating beam 232*b*. The first and second mating beams 232*a*, 232*b* may be similar to one another. Portions or features of the mating beams 232 may be described with reference to the first mating beam 232*a*, the second mating beam 232*b* and/or generically to the mating beams 232.

Figure 6:
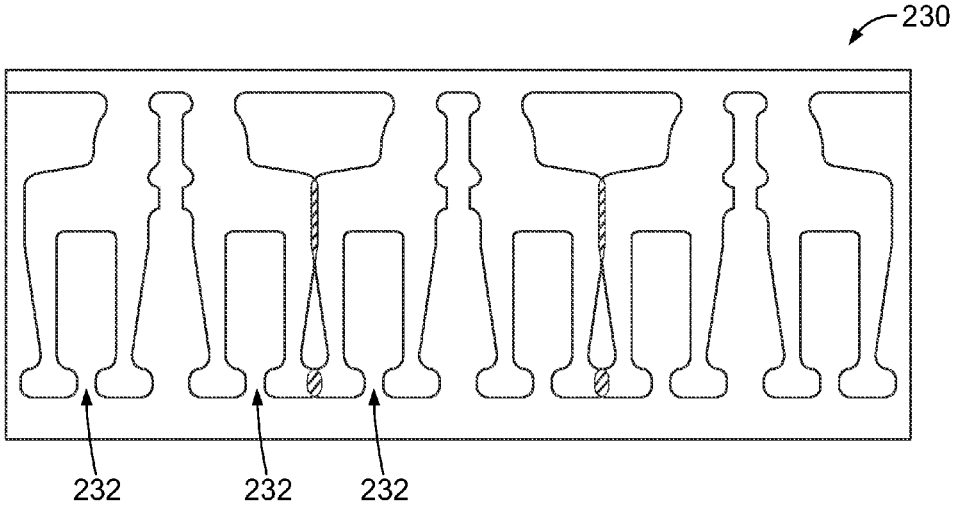
FIG. 6 illustrates the leadframe with the mating beams in a non-angled or straight orientation.

Each mating beam 232 includes a stem 262 at the base of the mating beam 232. The first paddle 252 extends from the stem 262. Each mating beam 232 includes a branch 264 extending from the stem 262. The second paddle 254 extends from the branch 264. The first and second paddles 252, 254 extend generally forward from the stem 262 and branch 264, respectively. The branch 264 and second paddle 254 form part of the folded over portion 256 (shown in FIG. 4) after the mating beam 232 is bent or formed into the final shape, thus allowing each mating beam to have two points of contact with the corresponding header contact 120 (shown in FIG. 1). However, providing the branch 264 and second paddle 254 increases the overall width of each mating beam 232, as each paddle 252, 254 needs to have a certain width for mechanical durability, and the branch 264 needs to have a certain width to form the folded over portion 256 to position the paddles 252, 254 at a predetermined distance apart from each other. The paddles 252, 254 need to have certain widths to control the impedance, and, therefore, the signal integrity performance of the connector in the area of the mating beam 232. In an exemplary embodiment, in order to have the mating beams 232 arranged on a tight pitch, and thus provide a greater number of signal contacts 162 along the front of the contact module 160 (shown in FIG. 2), the mating beams 232 are stamped inward on angles and later moved or bent outward to final, parallel positions, as will be described in greater detail below. Optionally, if the mating beams 232 were not angled inward, the mating beams 232 of adjacent pairs 260 of signal contacts 162 would overlap. For example, FIG. 6 illustrates the mating beams 232 in a non-angled or straight orientation. As shown in FIG. 6, adjacent mating beams 232 overlap, as shown by the shaded regions. It is clear that without angling the mating beams 232, the mating beams 232 would have to be spread further apart, at least to accommodate a tool or punch between the mating beams 232 to stamp the mating beams 232 from the blank or sheet used to form the leadframe 230. If the mating beams 232 were spread apart, the final pitch or spacing between the mating beams 232 would likewise be further spread apart, leading to either a larger contact module 162 or fewer mating beams 232 and corresponding signal contacts 162.

Returning to FIG. 5, in the illustrated embodiment, the first and second mating beams 232*a*, 232*b* are mirrored across a centerline 266. The centerline 266 extends in a forward direction perpendicular to the front of the leadframe 230. The centerline 266 may be parallel to a mating direction (arrow A) of the header contacts 120 (shown in FIG. 1) and signal contacts 162. The centerline 266 may be parallel to a mating axis along which the second connector 106 (shown in FIG. 1) is mated with the corresponding header assembly 118 (shown in FIG. 1). The centerlines 266 between the mating beams 232 of each pair 260 are parallel to one another. The first mating beam 232*a* is arranged on one side of the centerline 266 and has a generally h-shape, while the second mating beam 232*b* is arranged on the opposite side of the centerline 266 and has an inverted or backwards h-shape; however other shapes are possible in alternative embodiments. The stems 262 of the first and second mating beams 232*a*, 232*b* are initially connected by a connecting portion 268 of the carrier, however such connecting portion 268 is later removed to allow the first and second mating beams 232*a*, 232*b* to be spread apart. The centerline 266 may pass through the connecting portion 268.

In an exemplary embodiment, in the initial stamped orientation, the leadframe 230 is stamped such that the first and second mating beams 232*a*, 232*b* of the first and second signal contacts 162 within the same pair 260 of signal contacts 162 are angled toward one another. Such mating beams 232*a*, 232*b* are angled toward the centerline 266. Such mating beams 232*a*, 232*b* are angled away from the adjacent mating beams 232 of adjacent pairs 260 of signal contacts 162.

In the initial, stamped orientation, the leadframe 230 is stamped such that the first paddle 252 of the first mating beam 232*a* extends along a first paddle axis 270 angled oblique to the centerline 266. The second paddle 254 of the first mating beam 232*a* extends along a second paddle axis 272 that is generally parallel to the first paddle axis 270. Alternatively, the second paddle axis 272 may be angled at a different angle than the first paddle axis 270. The first paddle 252 of the second mating beam 232*b* extends along a third paddle axis 274 angled oblique with respect to the centerline 266. The second paddle 254 of the second mating beam 232*b* extends along a fourth paddle axis 276 that is generally parallel to the third paddle axis 274. Alternatively, the fourth paddle axis 276 may be angled at a different angle than the third paddle axis 272. Each of the paddle axes 270, 272, 274, 276 is angled oblique to the centerline 266. The first and second paddle axes 270, 272 may be angled inward at first and second angles 280, 281, respectively, to the centerline 266. The third and fourth paddle axes 274, 276 may be angled inward at third and fourth angles 282, 283, respectively, to the centerline 266. The first and third angles 280, 282 may be approximately equal angles to the centerline 266. For example, the first angle 280 may be approximately +3°, while the third angle 282 may be approximately −3°. The second and fourth angles 281, 283 may be approximately equal angles to the centerline 266. For example, the second angle 281 may be approximately +3°, while the fourth angle 283 may be approximately −3°. The angles 280, 281, 282, 283 may be other angles in alternative embodiments, such as approximately +/−5°, +/−10°, and the like. Alternatively, the first and third paddle axes 270, 274 may be angled less or not angled at all relative to the centerline 266, while the second and fourth paddle axes 272, 276 are angled at greater angles than the angles of the first and third paddle axes 270, 274.

The first paddles 252 are arranged interior of the second paddles 254 closer to the centerline 266. The second paddles have exterior edges 284 facing outward away from the centerline 266. Optionally, the exterior edges 284 of the second paddles 254 are angled oblique to the centerline 266. Optionally, the exterior edges 284 may be oriented parallel to the corresponding paddle axes 272, 276. The second paddles 254 are arranged outside of the first paddles 252. Adjacent second paddles 254 of mating beams 232 of different pairs 260 are angled away from one another. For example, the second paddle 254 of the first mating beam 232*a* of one pair 260 is positioned adjacent to the second paddle 254 of the second mating beam 232*b* of an adjacent pair 260. Both such paddles 254 are angled in opposite directions toward their corresponding centerlines 266.

After the leadframe 230 is stamped, the leadframe 230 is processed by bending, drawing, forming or other metalworking processes to shape the leadframe 230, such as the mating beams 232. The branch 264 and second paddle 254 of each mating beam 232 are folded over the stem 262 and first paddle 252 of the corresponding mating beam 232. The first and second paddles 252, 254 are arranged parallel to one another and define a socket 290 (shown in FIG. 3) configured to receive the corresponding header contact 120. Optionally, because the mating beams 232 are initially stamped on angles with the mating beams of each pair 260 angled inward toward one another, after initially being folded over, the first and second paddles 252, 254 and corresponding sockets 290, are likewise angled inward such that the sockets 290 are oblique and non-parallel to the mating direction (arrow A) with the header contacts 120. The mating beams 232 are further processed after the folding over process to bend, form or otherwise press the mating beams 232 outward to a final, formed orientation (such as the orientation shown in FIG. 3) wherein the centerlines of the first and second paddles 252, 254 of each pair 260 are parallel to one another. The paddles 252, 254 are pressed such that the sockets 290 are parallel to the centerlines 266 and mating direction (arrow A). Optionally, the mating beams 232 are pressed outward after the connecting portions 268 are removed, allowing the stems 262 to spread apart from each other.

Figure 7:
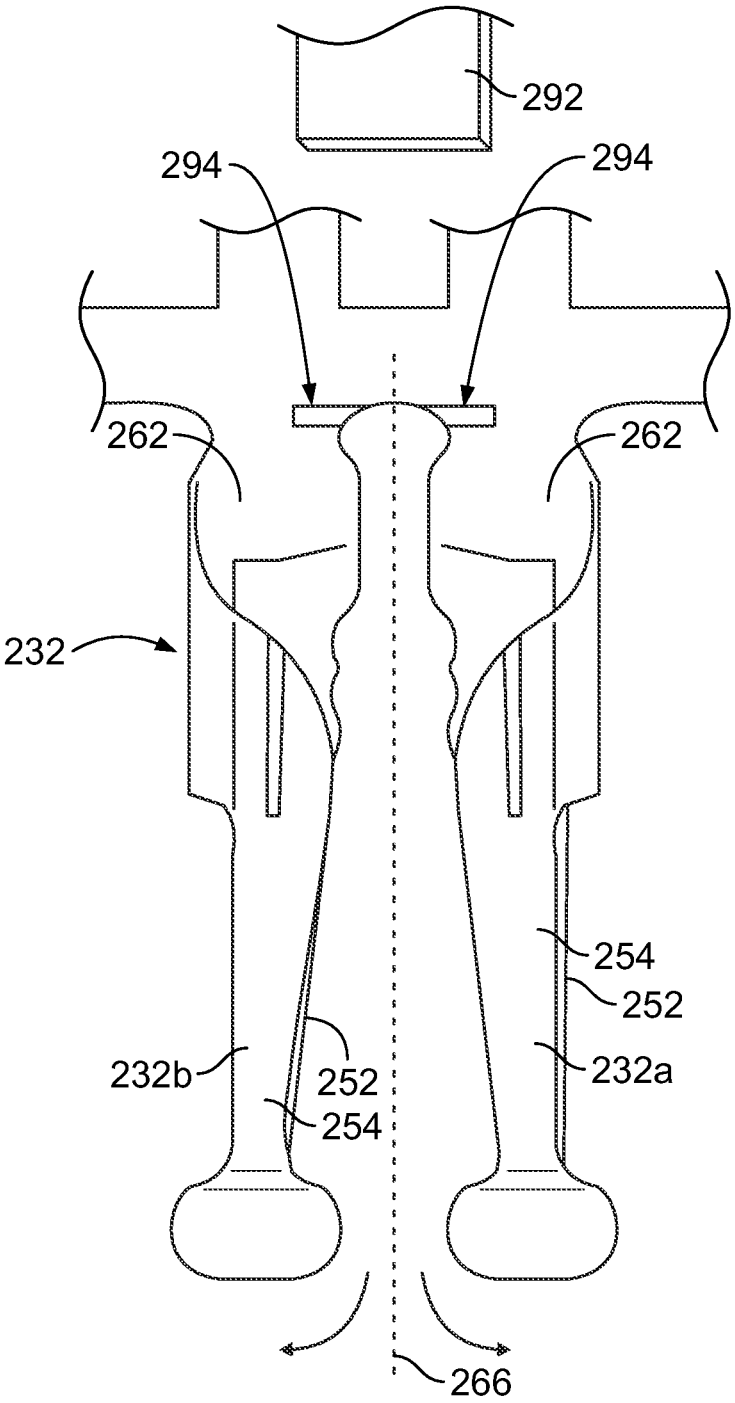
FIG. 7 illustrates a portion of the leadframe with the mating beams in a final, formed state.

FIG. 7 illustrates a portion of the leadframe 230 with the mating beams 232 in a final, formed state. In an exemplary embodiment, an adjuster punch 292 is used to press the mating beams 232*a*, 232*b* outward away from each other. The adjuster punch 292 presses into the interior edges of the stems 262 of the mating beams 232*a*, 232*b* to form punch marks 294. As the material of the stems 262 is coined or pressed during the forming of the punch marks 294, the stems 262 along the interior edges lengthen, causing the mating beams 232*a*, 232*b* to rotate outward. The mating beams 232*a*, 232*b* are pressed or rotated away from each other such that the paddles 252, 254 are generally parallel to each other and to the centerline 266. Other types of devices or processes may be used to position the mating beams 232*a*, 232*b* in the final or true positions.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A leadframe for a contact module, the leadframe comprising:

signal contacts arranged in pairs carrying differential signals, each pair of signal contacts comprising a first signal contact and a second signal contact, each signal contact having a mating beam at an end thereof, each mating beam configured to be electrically connected to a corresponding header contact of a header assembly, each mating beam comprising a stem and a branch extending from the stem, each mating beam comprising a first paddle extending from the stem and a second paddle extending from the branch, wherein, in an initial stamped orientation, the mating beams are stamped such that the mating beams of the first and second signal contacts within the same pair of signal contacts are angled non-parallel to one another.

2. The leadframe of claim 1, wherein a centerline is defined between the mating beams of the first and second signal contacts within the same pair, the first paddle of the mating beam associated with the first signal contact extending along a first paddle axis angled oblique with respect to the centerline, the first paddle of the mating beam associated with the second signal contact extending along a second paddle axis angled oblique with respect to the centerline.

3. The leadframe of claim 2, wherein the first and second paddle axes are angled inward at approximately equal angles relative to the centerline.

4. The leadframe of claim 1, wherein a centerline is defined between the mating beams of the first and second signal contacts within the same pair, the first paddle of the mating beam associated with the first signal contact extending along a first paddle axis angled oblique with respect to the centerline, the second paddle of the mating beam associated with the first signal contact extending along a second paddle axis generally parallel to the first paddle axis.

5. The leadframe of claim 1, wherein the mating beams are arranged on a tight pitch, wherein if the mating beams were not angled inward, the mating beams of adjacent pairs of signal contacts would overlap.

6. The leadframe of claim 1, wherein a centerline is defined between the mating beams of the first and second signal contacts within the same pair, the first paddles arranged interior of the second paddles closer to the centerline, the second paddles having exterior edges facing outward away from the centerline, the exterior edges of the second paddles being angled oblique with respect to the centerline.

7. The leadframe of claim 1, wherein the second paddles are outside of the first paddles, adjacent second paddles of mating beams of signal contacts of different pairs being angled away from each other as the mating beams extend to ends of the mating beams.

8. The leadframe of claim 1, wherein the branch and second paddle of each mating beam are folded over the stem and first paddle of the corresponding mating beam such that the first and second paddles are parallel to one another and define a socket configured to receive the corresponding header contact.

9. The leadframe of claim 8, wherein the mating beams are pressed outward to a final, formed orientation wherein each of the first and second paddles are parallel to one another.

10. A method of manufacturing a leadframe comprising:

providing a leadframe by stamping a metal blank to include pairs of signal contacts having mating beams that are non-parallel to each other, wherein said providing a leadframe comprises stamping the metal blank to include the mating beams each having a stem and a branch extending from the stem, each mating beam having a first paddle extending from the stem and a second paddle extending from the branch, said providing a leadframe comprises stamping the metal blank such that the first and second paddles of each mating beam are angled inward toward a centerline between the mating beams of the pair of signal contacts; and forming the mating beams into a final form, the mating beams having a parallel alignment in the final form.

11. The method of claim 10, wherein said forming the mating beams comprises folding the branch and the second paddle over the stem and the first paddle such that a socket is defined between the first and second paddles, the socket being configured to receive a header contact of a header assembly.

12. The method of claim 11, wherein said forming the mating beams comprises pressing the mating beams of the pair of signal contacts outward away from each other such that the sockets are parallel to a mating direction of the mating beam with a header contact.

13. The method of claim 10, wherein said forming the mating beams comprises pressing the mating beams of each pair of signal contacts outward away from each other such that the mating beams are parallel to each other.

14. The method of claim 10, further comprising removing a connecting portion between the stems of the mating beams of the pair of signal contacts to allow the stems to be pressed outward away from each other.

15. A receptacle assembly comprising:

a receptacle housing configured to be mated with a header assembly; and contact modules received in the receptacle housing, the contact modules each comprising:

a dielectric frame having a front and opposite first and second sides; and a leadframe held by the dielectric frame, the leadframe having signal contacts arranged in pairs carrying differential signals, the signal contacts being generally arranged along a leadframe plane parallel to and between the first and second sides, the signal contacts having mating beams at ends thereof, each mating beam extending forward of the dielectric frame to be electrically connected to a corresponding header contact of the header assembly in a mating direction, each mating beam comprising a stem and a branch, each mating beam comprising a first paddle extending from the stem and a second paddle extending from the branch;

wherein the mating beams are stamped in an initial, stamped orientation such that the mating beams within the same pair of signal contacts are angled toward one another and such that the mating beams are angled away from the mating beams of any immediately adjacent pair of signal contacts, the branch and second paddle of each mating beam being folded over the stem and first paddle such that the first and second paddles are parallel to one another and define a socket for the corresponding header contact of the header assembly, the mating beams being pressed to a final, formed orientation such that each of the first and second paddles are parallel to the mating direction.

16. The receptacle assembly of claim 15, wherein a centerline is defined between the mating beams of the signal contacts within the same pair, the first paddle of the mating beam associated with a first signal contact within a pair extending along a first paddle axis angled oblique with respect to the centerline, the first paddle of the mating beam associated with a second signal contact within the pair extending along a second paddle axis angled oblique with respect to the centerline.

17. The receptacle assembly of claim 16, wherein the first and second paddle axes are angled inward at approximately equal angles relative to the centerline.

18. The receptacle assembly of claim 15, wherein a centerline is defined between the mating beams of the signal contacts within the same pair, the first paddle extending along a first paddle axis angled oblique with respect to the centerline, the second paddle associated with such first paddle extending along a second paddle axis generally parallel to the first paddle axis.

19. The receptacle assembly of claim 15, the second paddles are outside of the first paddles, adjacent second paddles of mating beams of signal contacts of different pairs being angled away from each other.

* * * * *